US007337564B2

(12) United States Patent
Kimble

(10) Patent No.: US 7,337,564 B2
(45) Date of Patent: Mar. 4, 2008

(54) LOADER COUPLER OR OTHER ATTACHMENT WITH ADJUSTABLE STOPS

(75) Inventor: Allen E. Kimble, Rock Spring, GA (US)

(73) Assignee: JRB Attachments, LLC, Cedar Rapids, IA (US)

( * ) Notice: Subject to any disclaimer, the term of this patent is extended or adjusted under 35 U.S.C. 154(b) by 138 days.

(21) Appl. No.: 10/958,836

(22) Filed: Oct. 5, 2004

(65) Prior Publication Data

US 2005/0045348 A1 Mar. 3, 2005

Related U.S. Application Data

(63) Continuation-in-part of application No. 09/999,868, filed on Oct. 23, 2001, now Pat. No. 6,886,279.

(60) Provisional application No. 60/242,635, filed on Oct. 23, 2000, provisional application No. 60/513,064, filed on Oct. 21, 2003.

(51) Int. Cl.
*E02F 3/36* (2006.01)

(52) U.S. Cl. ..... 37/468; 37/903; 414/723; 403/24

(58) Field of Classification Search ..... 16/86 B, 16/2.1, 375, 374; 37/468, 903; 172/272, 172/905; 414/723; 403/24
See application file for complete search history.

(56) References Cited

U.S. PATENT DOCUMENTS

| | | | | |
|---|---|---|---|---|
| 4,100,368 | A * | 7/1978 | Thomsen | 174/138 D |
| 4,480,843 | A * | 11/1984 | Springer et al. | 277/343 |
| 4,708,579 | A | 11/1987 | Baird et al. | |
| 4,768,917 | A | 9/1988 | Garman | |
| 5,361,425 | A * | 11/1994 | Armanno, Sr. | 4/248 |
| 5,529,419 | A | 6/1996 | Gebauer | |
| 5,692,850 | A | 12/1997 | Kimble et al. | |
| 5,974,706 | A | 11/1999 | Kaczmarski et al. | |
| 5,983,535 | A | 11/1999 | Kaczmarski et al. | |
| 6,163,989 | A | 12/2000 | Kaczmarski et al. | |

* cited by examiner

*Primary Examiner*—Christopher J. Novosad
(74) *Attorney, Agent, or Firm*—Fay Sharpe LLP

(57) ABSTRACT

A loader coupler or other attachment includes first and second roll-back stops located on opposite lateral sides. The stops include a mounting location such as a boss, a bumper or stop member releasably secured to the mounting location, and optionally one or more shims disposed between the mounting location and the stop member. The number and thickness of the shims may be used to control the spacing of the first and second stop members from their respective mounting locations to thus control the angular position of the coupler when the stop members contact the respective arms of the machine carrying the coupler.

9 Claims, 13 Drawing Sheets

LOADER COUPLER OR OTHER ATTACHMENT WITH ADJUSTABLE STOPS

CROSS-REFERENCE TO RELATED APPLICATION

This application is a continuation-in-part of U.S. application Ser. No. 09/999,868, filed on Oct. 23, 2001, now U.S. Pat. No. 6,886,279, which claims benefit of the filing date of and priority from U.S. Provisional Application Ser. No. 60/242,635, filed on Oct. 23, 2000. This application also claims benefit of the filing date of and priority under 35 U.S.C. §119 to U.S. Provisional Application Ser. No. 60/513,064, filed on Oct. 21, 2003.

BACKGROUND OF THE INVENTION

The present invention relates generally to the art of heavy machinery and, more particularly, to the art of couplers for loader buckets and the like as used on wheel loaders, tractor loader backhoes and the like. Examples of such couplers are disclosed in commonly assigned U.S. Pat. Nos. 4,708,579, 5,529,419 and 5,692,850, the disclosures of which are hereby expressly incorporated by reference.

It is known to equip couplers for loader buckets and the like with stops that engage the arms or other fixed portion of the associated machinery to prevent further pivoting movement of the coupler and, thus, the bucket or other attachment connected thereto relative to the arms or other fixed structure. For example, couplers for loader buckets typically include a pair of dump stops located on opposite lateral sides of the coupler and adapted to engage the loader arms and prevent pivoting movement of the bucket in a first direction beyond a predefined dump position. Likewise, these couplers include a pair of roll-back stops located on opposite lateral sides of the coupler and adapted to engage to loader arms and prevent pivoting movement of the bucket in an opposite, second direction beyond a predefined roll-back position. These stops are permanently and non-adjustably secured to the coupler body by welding or other means.

These prior, fixed stops are deficient in many respects. First, due to manufacturing tolerances and tolerance build-up, oftentimes the stops do not engage the loader arms as desired. This can lead to stress on the hydraulic cylinder(s) used to pivot the coupler and other components. Secondly, while the stops may perform perfectly on a first loader or other machine carrying the coupler, the stops may not be properly positioned for a different loader or other machine. Thus, a need has been identified for a coupler including adjustable dump and/or roll-back stops.

SUMMARY

The present disclosure provides, in one aspect, a loader coupler comprising first and second roll-back stop assemblies located on opposite lateral sides of the coupler. Each of the roll-back stops comprises a mounting location, a stop member releasably connected to the mounting location, and at least one shim located between the mounting location and the stop member.

The present disclosure provides, in another aspect, a loader coupler comprising first and second adjustable roll-back stop assemblies located on opposite lateral sides of the coupler, each of the roll-back stop assemblies comprising a mounting location, a bumper releasably connected to the mounting location, and optionally one or more shims located between the bumper and the mounting location. The bumper is formed from a polymeric material.

The present disclosure also provides, in yet another aspect, a loader coupler comprising first and second adjustable roll-back stops located on opposite lateral sides of the coupler, and first and second dump stops located on opposite lateral sides of the coupler. Each of the roll-back stops comprises a mounting location, a stop member formed from a polymeric material releasably connected to the mounting location, and one or more shims removably disposed between the mounting location and the stop member.

In still another aspect, the present disclosure provides an adjustable stop assembly for an attachment such as a loader coupler, bucket, or the like, the adjustable stop assembly comprising a mounting location, a stop member releasably connected to the mounting location, and optionally one or more shims releasably disposed between the mounting location and the stop member.

In a further aspect, the present disclosure provides an attachment for a machine comprising a first pin-on location; a second pin-on location; and first and second adjustable stop assemblies located on opposite lateral sides of the attachment, said first and second adjustable stop assemblies being aligned with and spaced from the first and second pin-on locations, respectively. Each of said first and second adjustable stop assemblies comprises a mounting location, a stop member releasably connected to said mounting location, and at least one shim removably located between said mounting location and said stop member.

BRIEF DESCRIPTION OF THE DRAWINGS

The invention comprises a variety of components and arrangements of components, preferred embodiments of which are illustrated in the accompanying drawings that form a part of this specification and wherein.

DETAILED DESCRIPTION OF THE PREFERRED EMBODIMENT

Figure 1:
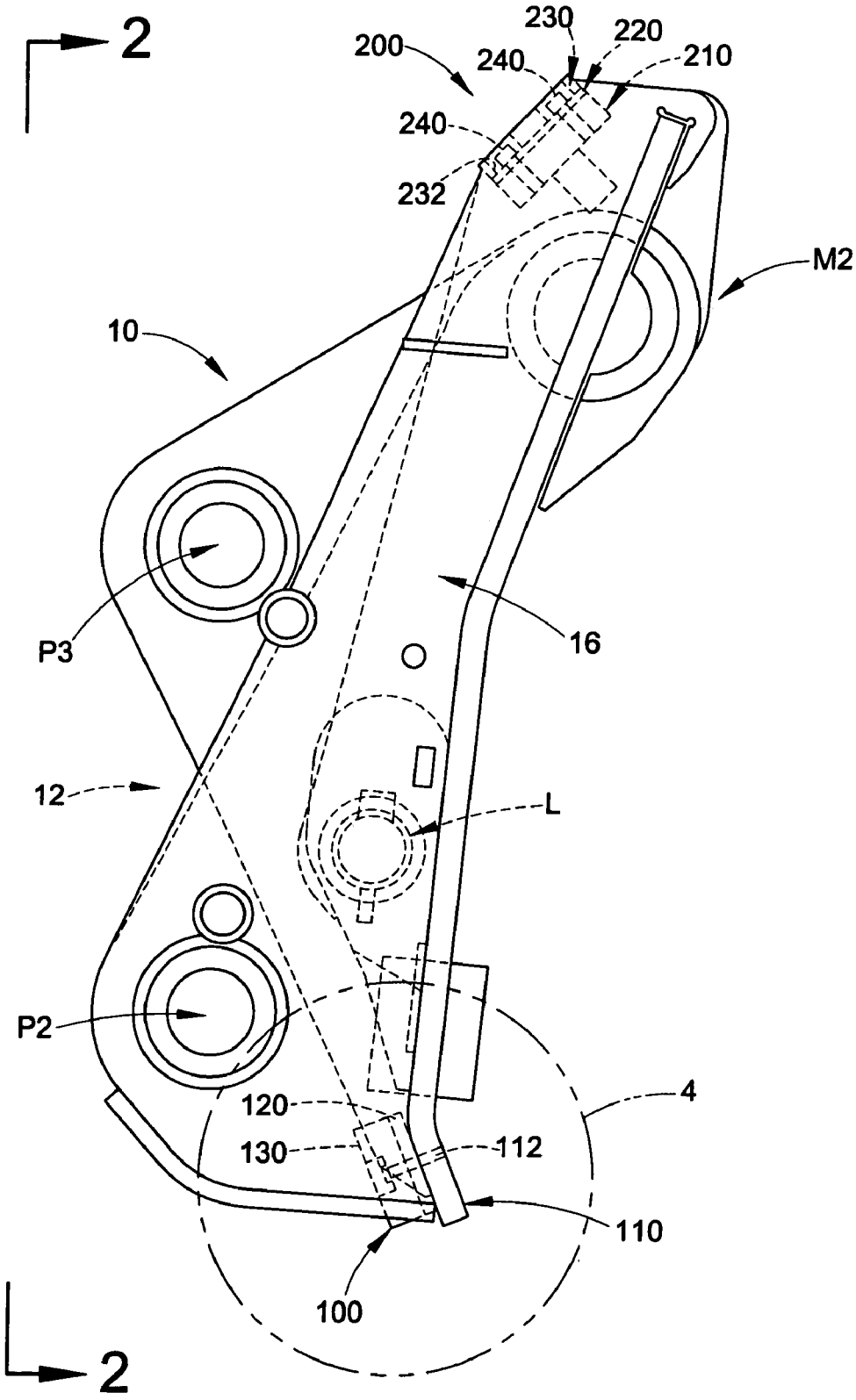
FIG. 1 is a side elevational view of a loader coupler with adjustable dump and roll-back stops formed in accordance with a first embodiment of the present invention.
Figure 2:
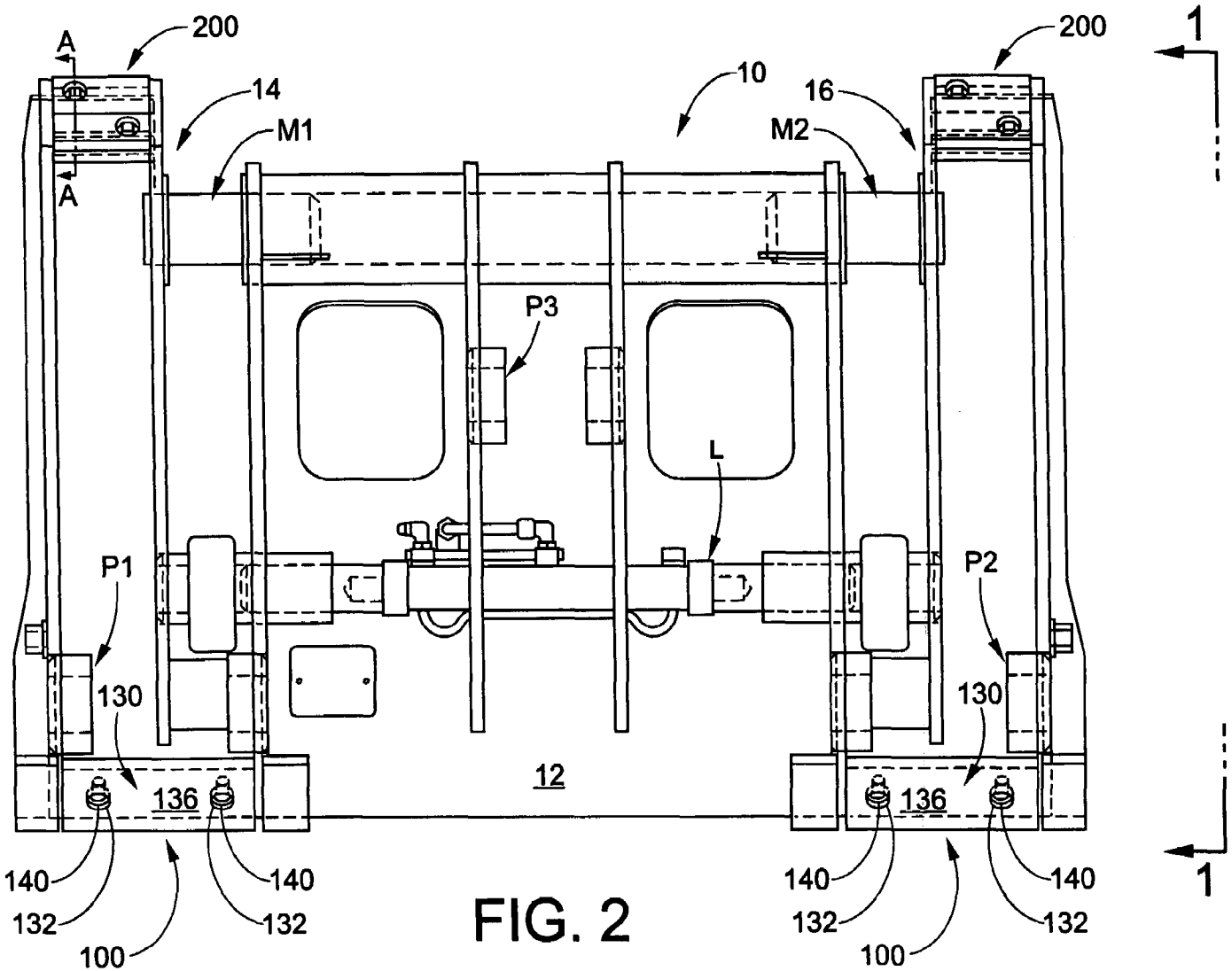
FIG. 2 is a rear elevational view of the loader coupler of FIG. 1 as taken along line 2-2 of FIG. 1.

FIGS. 1 and 2 illustrate a loader coupler 10 that is conventional in all respects except that it is equipped with adjustable dump stops 100 and adjustable roll-back stops 200 formed in accordance with the present invention. The coupler 10 comprises first and second arm pin-on locations P1, P2 where first and second arms of a loader or other machine are respectively pivotally connected to the coupler 10. The coupler 10 further comprises at least one tilt-link pin-on location P3 where a hydraulic cylinder or other actuator is operably connected to the coupler 10 in order to control the angular position of the coupler 10 relative to the first and second loader arms. Also, as with conventional loader couplers, the coupler 10 comprises first and second pick-up locations M1,M2 that are adapted to be received into mating female ribs of a bucket or other attachment for operably coupling the bucket or other attachment to the coupler 10. The coupler 10 also comprises a lock assembly L used to engage and capture the mating female ribs to the coupler when the female ribs are mated with the pick-up locations M1, M2.

The dump stops 100 are located on a rear face or portion 12 (the face oriented toward the loader or other associated machine carrying the coupler 10) of the coupler 10 on opposite lateral sides 14, 16 thereof. Likewise, the roll-back stops 200 are located on the rear face 12 of the coupler 10 on its opposite lateral sides 14,16 and are aligned with but spaced from the dump stops 100. Those of ordinary skill in the art will recognize that the dump and roll-back stops 100,200 are located in positions that correspond to the location of conventional dump and roll-back stops, respectively. For simplicity and ease of understanding the invention, only one dump stop 100 and one roll-back stop 200 (those located on the second lateral side 16 of the coupler 10) are described in detail below. Those of ordinary skill in the art will recognize that the dump and roll-back stops located on the opposite lateral side 14 of the coupler 10 are identical or substantially identical. Also, unless otherwise specified, the components of the coupler 10 and stops 100,200 are defined from steel or another suitable durable metal or alloy.

Figure 4:
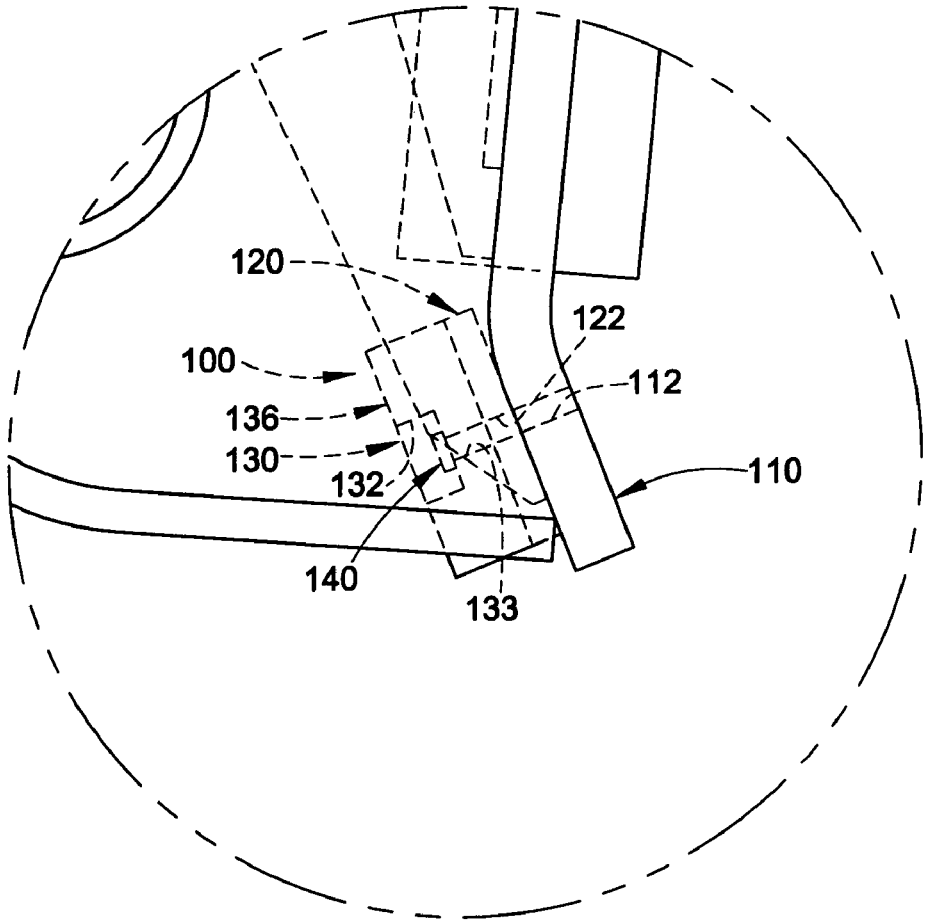
FIG. 4 is an enlarged portion of FIG. 1 showing a dump stop.
Figure 5A:
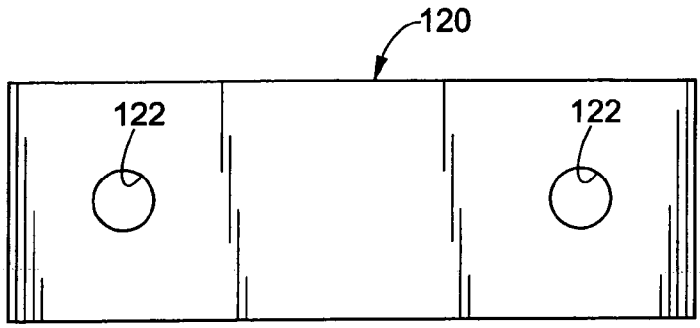
FIGS. 5A and 5B are plan and side elevational views, respectively, of a dump stop shim.
Figure 5B:
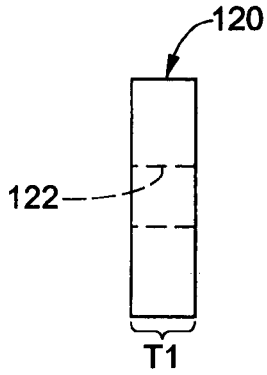

With reference to FIG. 4, the dump stop 100 comprises a dump stop base 110 that is welded to or otherwise integral with or defined as a one-piece construction with the coupler 10 or a base plate thereof and that defines at least one threaded bore 112 (only one shown in FIG. 1). One or more shims 120 of varying desired thickness are operatively positioned adjacent the dump stop base 110. A shim 120 formed in accordance with the present invention is shown in FIGS. 5A and 5B. The shim 120 defines a thickness T1 and first and second through-bores 122 (not threaded) that are located so that, when the shim 120 is operatively placed adjacent the dump stop base 110, the bores 122 are registered or aligned with the threaded bores 112 defined in the dump stop base 110. A dump stop cover 130 is placed adjacent the shim(s) 120 as shown in FIGS. 1, 2 and 4. The cover 130, shown separately in FIGS. 6A and 6B defines at least one and, as shown herein, first and second bores 133 and counterbores 132 that are located so that they are aligned or registered with the bores 122 of the shim(s) 120 and the bores 112 of the dump stop base 110 when the cover 130 is operably positioned adjacent the shim(s) 120. Bolts or other suitable fasteners 140 are inserted into through the bores 133,122, and threaded into the bores 112 of the dump stop base 110 to secure the shim(s) 120 and the dump stop cover 130 fixedly and operatively to the dump stop base 110. Owing to the presence of the counterbores 132, the heads of the bolts 140 are recessed into the cover 130.

Figure 6A:
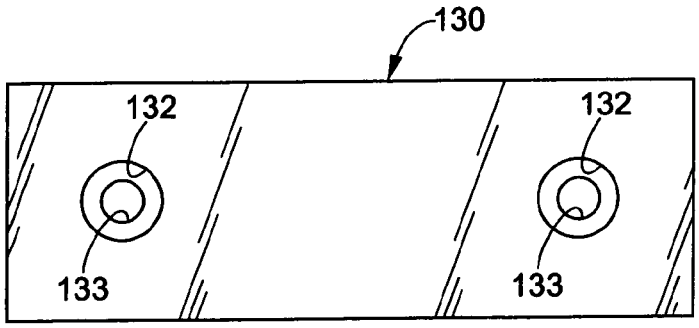
FIGS. 6A and 6B are plan and side elevational views, respectively, of a dump stop cover.
Figure 6B:
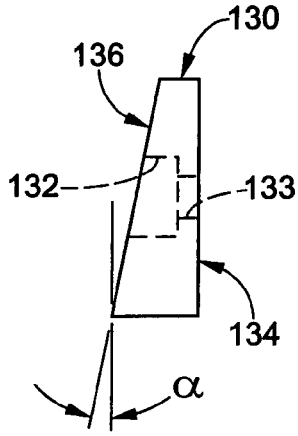

With reference now to FIGS. 6A and 6B, the dump stop cover 130 defines a planar inner face 134 adapted to lie adjacent a shim 120. An opposite, outer face 136 of the dump stop cover is also preferably planar, and is arranged parallel to the inner face 134 (FIG. 4) or angled relative thereto as shown in FIG. 6B by an angle $\alpha$ that can vary between 2° and 8° or otherwise as desired. Those of ordinary skill in the art will recognize that, by altering the angle $\alpha$, flush contact between the outer face 136 and an associated arm or other component of a loader or the like can be ensured. Also, the counterbore 132 ensures that heads of the bolts 140 are countersunk into the cover 130 and do not project outwardly beyond the surface 136. The number and/or thickness of the one or more shims 120 controls the distance between the outer surface 136 and the dump stop base 110 to provide an adjustable stop position.

Figure 3:
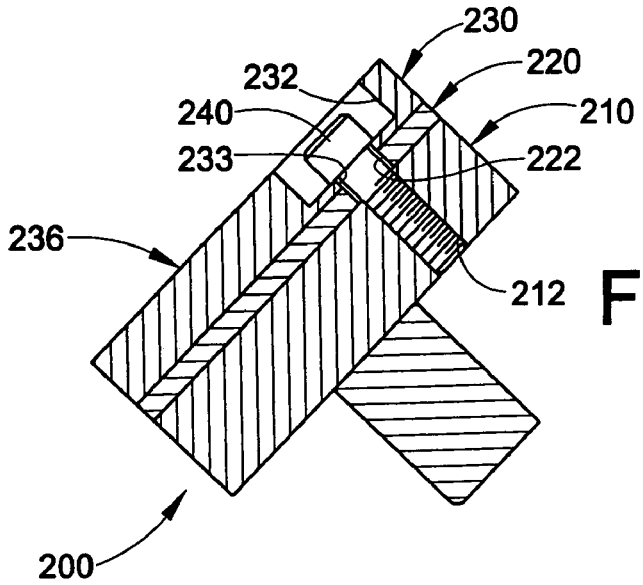
FIG. 3 is a sectional view of a roll-back stop as taken along line A-A of FIG. 2.
Figure 7A:
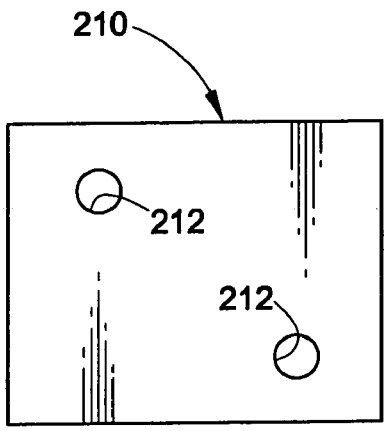
FIG. 7A is a plan view of a roll-back stop base.
Figure 7B:
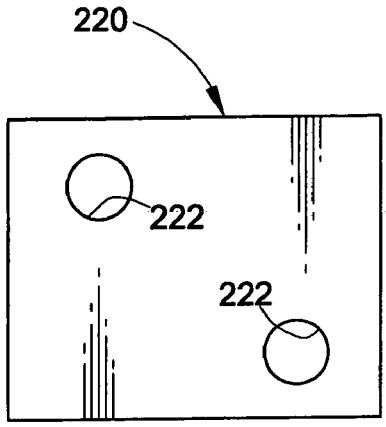
FIG. 7B is a plan view of a roll-back stop shim.
Figure 8A:
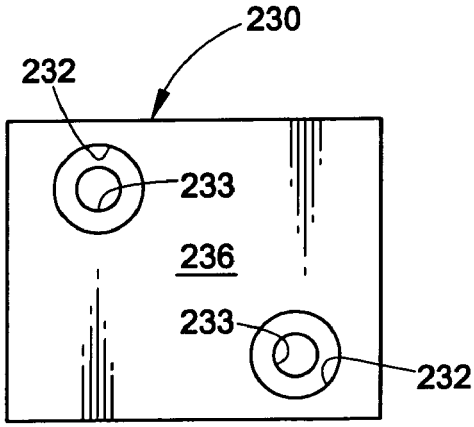
FIGS. 8A and 8B are plan and side elevational views, respectively, of a roll-back stop cover.
Figure 8B:
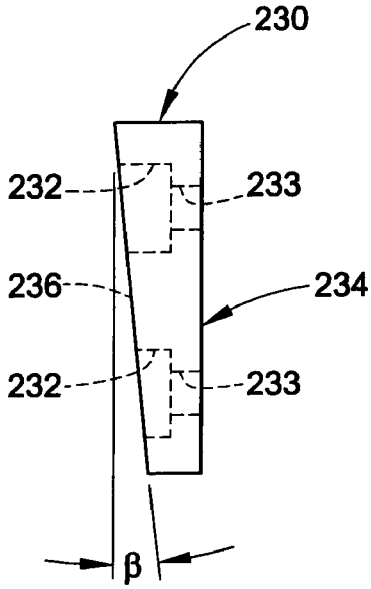

Referring to FIGS. 1 through 3, a roll-back stop 200 formed in accordance with the present invention comprises a roll-back stop base 210 that is welded to or otherwise integral with the coupler 10 or a component thereof. As shown in both FIGS. 3 and 7A, the roll-back stop base 210 defines threaded bores 212. One or more shims 220 (see also FIG. 7B) are placed adjacent the roll-back stop base 210. The shim(s) 220 define(s) through-bores 222 (not threaded) that are located so that they are aligned or registered with the bores 212 defined in the roll-back stop base 210 when the shim(s) 220 is operatively positioned adjacent the base 210. A roll-back stop cover 230 is placed adjacent the shim(s) 220. The cover 230, as shown in FIGS. 8A and 8B defines at least one and, as shown herein, first and second through-bores 233 and associated counterbores 232 that are located so that they are aligned or registered with the bores 222 of the shim(s) 220 and the bores 212 of the roll-back stop base 210 when the cover 230 is operably positioned adjacent the shim(s) 220. Bolts or other suitable fasteners 240 are inserted into through the bores 233,222, and threaded into the bores 212 of the roll-back stop base 210 to secure the shim(s) 220 and the dump stop cover 230 fixedly and operatively to the dump stop base 210.

With reference now particularly to FIG. 8B, the roll-back stop cover 230 defines a planar inner face 234 adapted to lie adjacent a shim 220. An opposite, outer face 236 of the roll-back stop cover 230 is also planar, and is arranged parallel to the inner face 234 (FIG. 3) or angled relative thereto as shown in FIG. 8B by an angle β that may be at least 2°, and; in embodiments, can vary between 2° and 8° or otherwise as desired. Those of ordinary skill in the art will recognize that, by altering the angle β, flush contact between the outer face 236 and an associated arm or other component of a loader or the like can be ensured. Also, the counterbore 232 ensures that heads of the bolts 240 are countersunk into the cover 230 and do not project outwardly beyond the surface 236. The number and/or thickness of the one or more shims 220 controls the distance between the outer surface 236 and the roll-back stop base 210 to provide an adjustable stop position.

Alternative Embodiment

Figure 9:
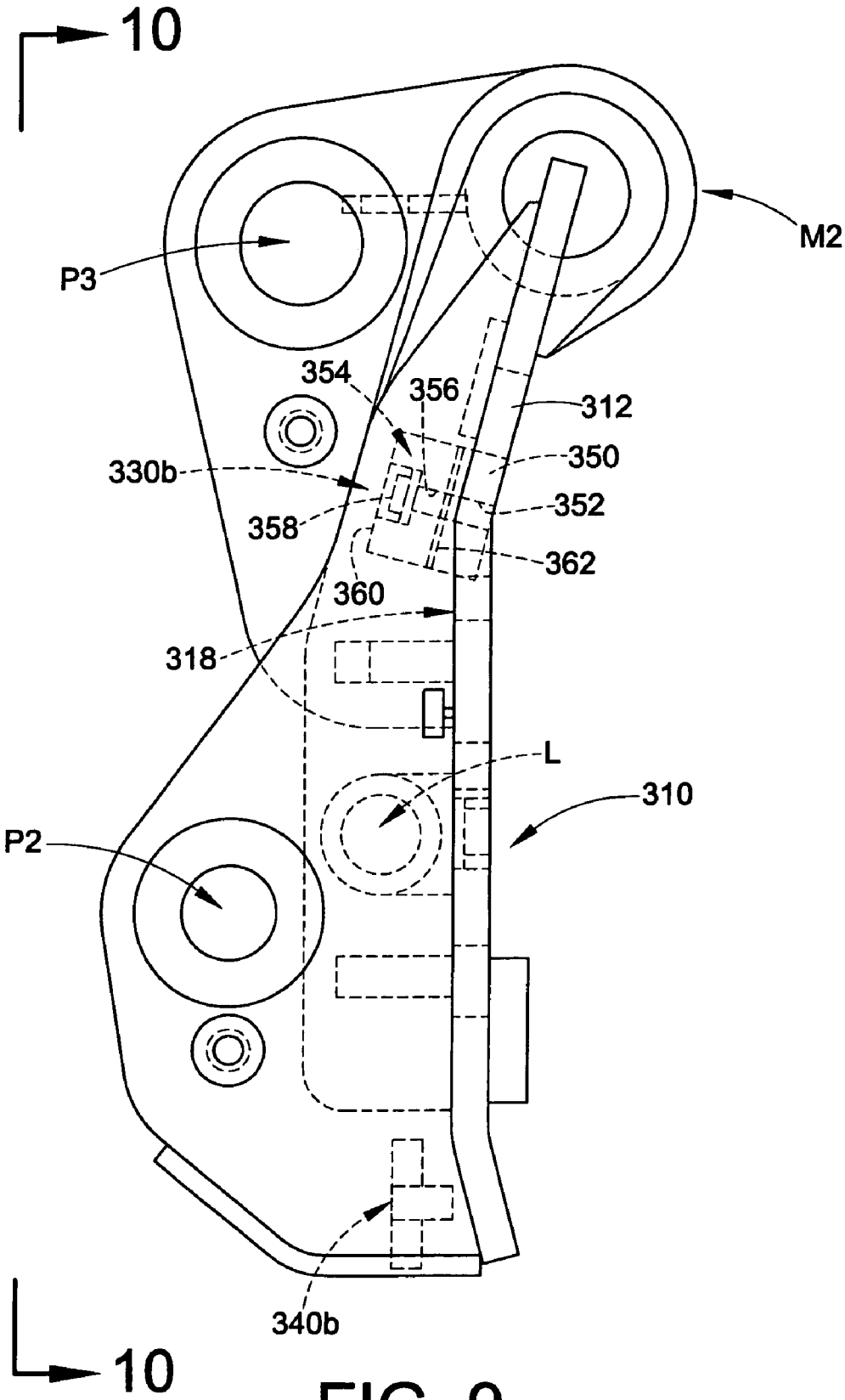
FIG. 9 is a side elevational view of a coupler formed in accordance with an alternative embodiment of the present invention.
Figure 10:
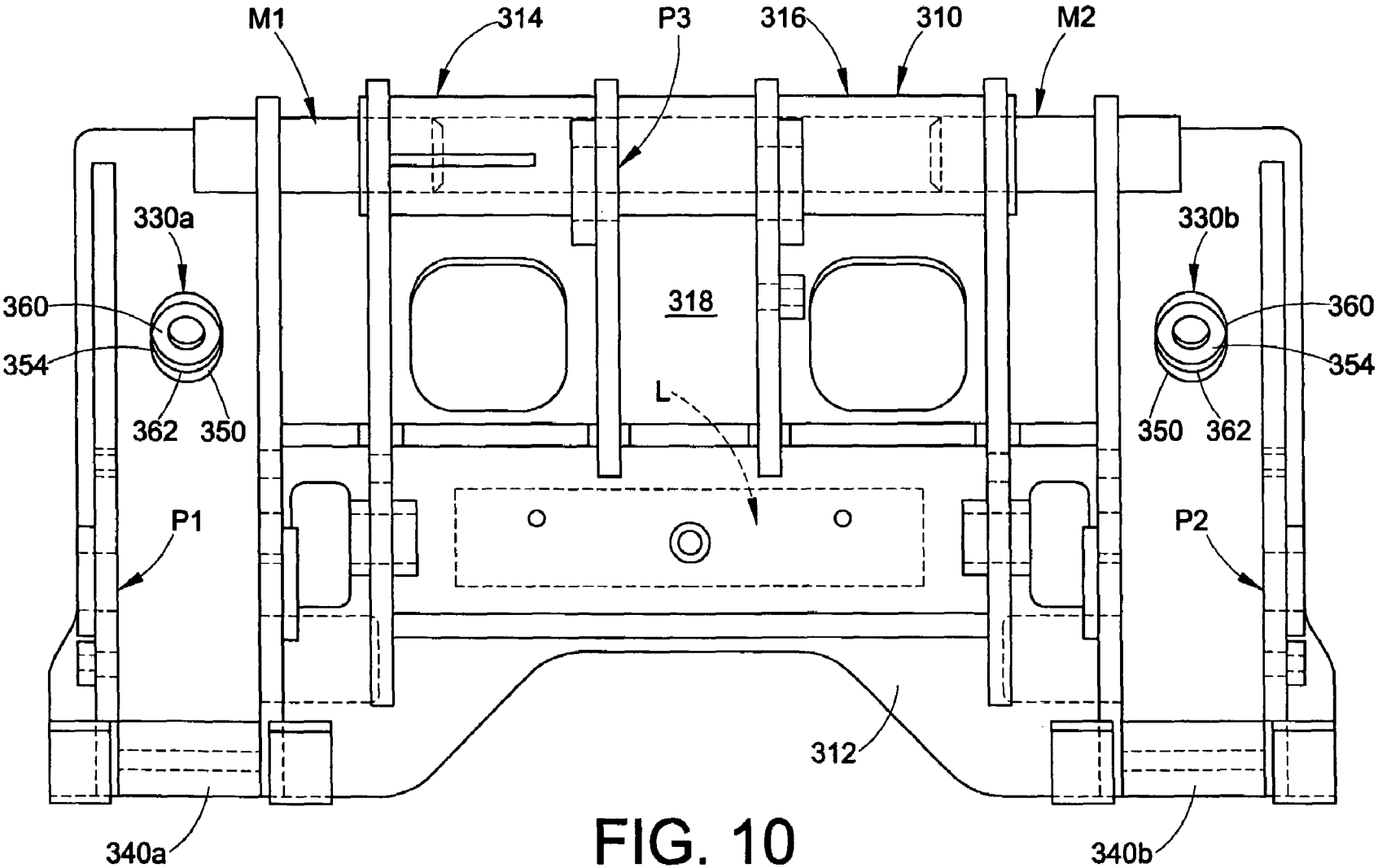
FIG. 10 is a rear elevational view of the coupler shown in FIG. 9 as taken along line 10-10.
Figure 11:
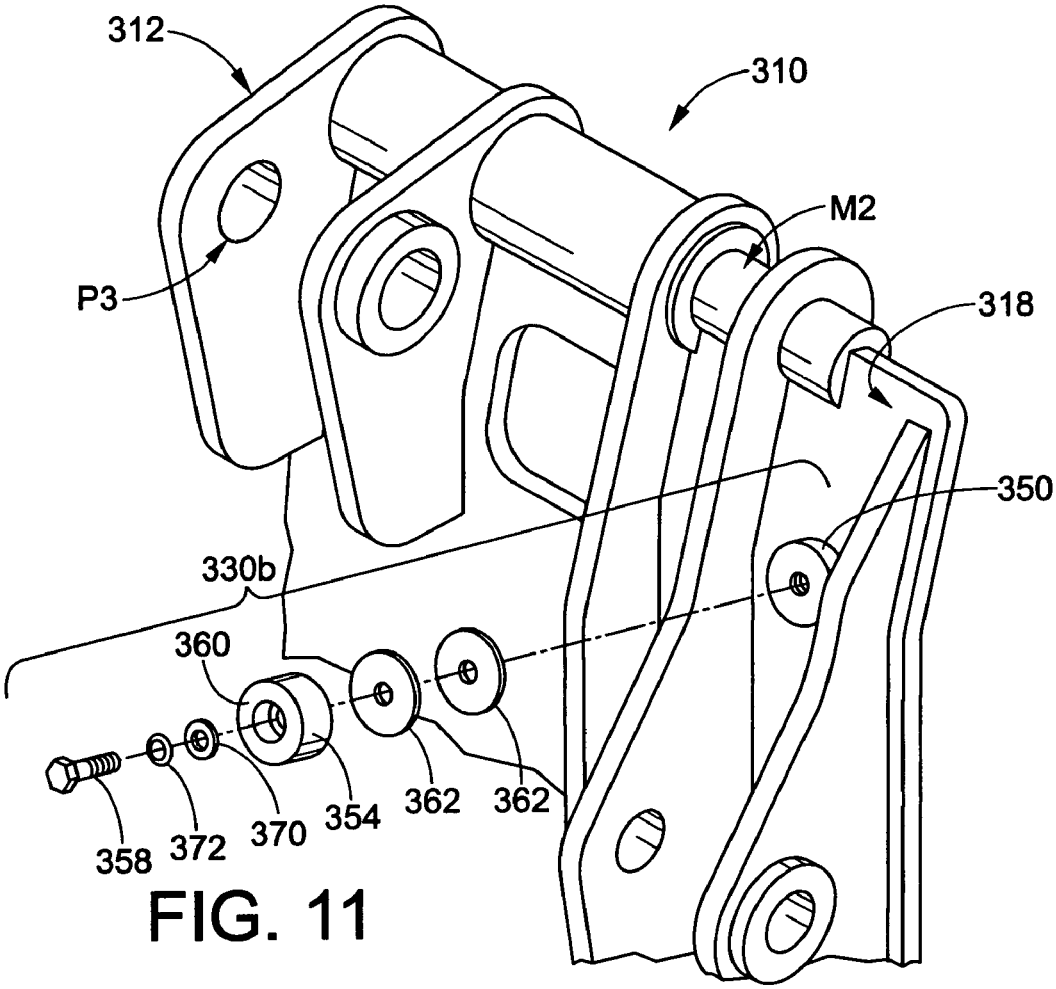
FIG. 11 is a partial perspective view of the coupler shown in FIGS. 9 and 10 and shows an exploded view of a roll-back stop assembly formed in accordance with the alternative embodiment.

FIGS. 9-11 illustrate a coupler 310 formed in accordance with an alternative embodiment. Except as shown and/or described, the coupler 310 is identical to the coupler 10 and like components are identified with like reference characters. New components are identified with new reference characters.

The coupler 310 comprises first and second arm pin-on locations P1, P2 where first and second arms of a loader or other machine are respectively pivotally connected to the coupler 310. The coupler 310 further comprises at least one tilt-link pin-on location P3 where a hydraulic cylinder or other actuator is operably connected to the coupler 310 in order to control the angular position of the coupler 310 relative to the first and second loader arms.

As with conventional loader couplers, the coupler 310 comprises first and second pick-up locations M1, M2 that are adapted to be received into mating female ribs of a bucket or other attachment for operably coupling the bucket or other attachment to the coupler 310. The coupler 310 also comprises a lock assembly L used to engage and capture the mating female ribs to the coupler when the female ribs are mated with the pick-up locations M1, M2.

As best seen in FIGS. 9 and 10, the coupler comprises first and second adjustable roll-back stop assemblies 330*a*, 330*b* located on opposite first and second lateral sides 314, 316 of the rear face 318 (oriented toward the loader or other machine to which the coupler 310 is connected). The first and second roll-back stop assemblies 330*a*, 330*b* are vertically aligned with and spaced from the first and second arm pin-on locations P1, P2, respectively, so as to be located to contact the respective first and second arms to which the coupler 310 is pivotally connected upon full roll-back of the coupler. The coupler 310 further comprises first and second conventional (fixed) dump stops 340*a*, 340*b*, and these can alternatively be provided as adjustable dump stops 100 as described above in relation to the coupler 10 or can be formed in the same manner as the adjustable stop assemblies 330*a*, 330*b*.

Figure 12:
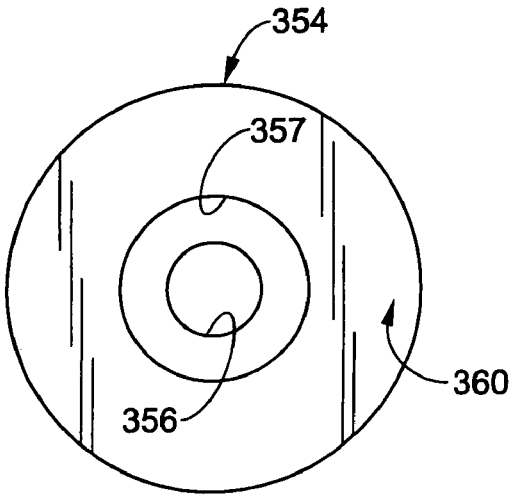
FIGS. 12 and 13 are rear and side views, respectively, of a roll-back stop bumper used on the coupler of FIGS. 9 and 10.
Figure 13:
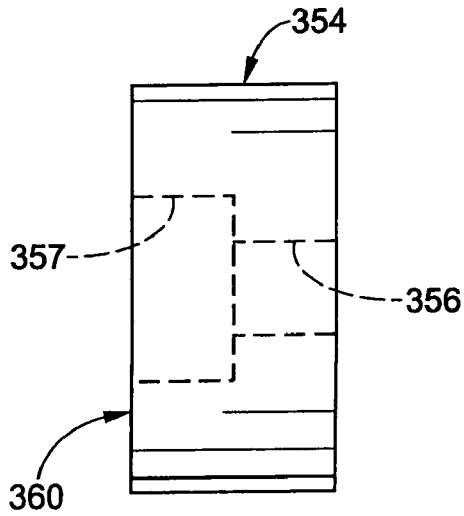
Figure 14:
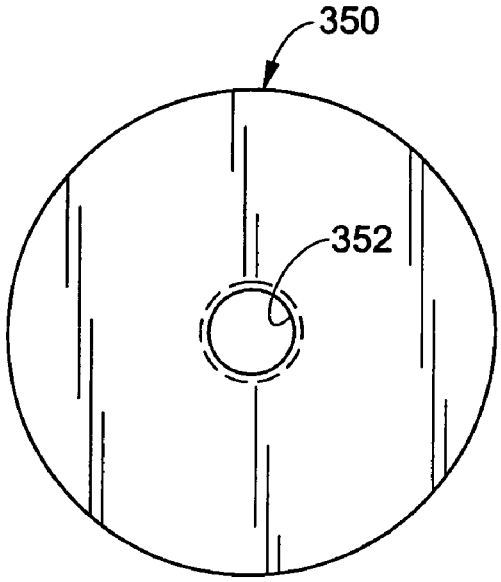
FIGS. 14 and 15 are rear and side views, respectively, of a mounting boss member that forms part of the roll-back stop assembly of the coupler shown in FIGS. 9 and 10.
Figure 15:
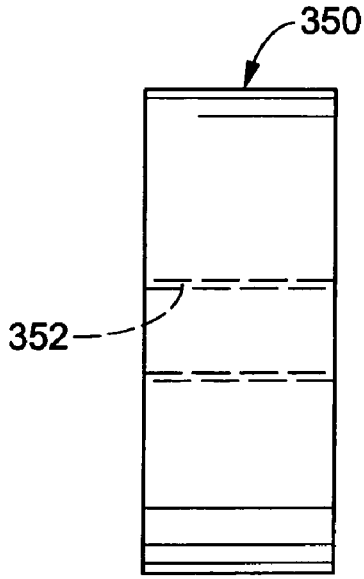
Figure 16:
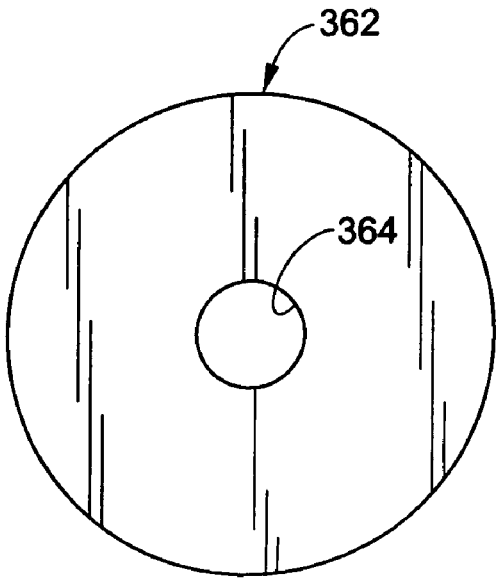
FIGS. 16 and 17 are rear and side views, respectively, of a shim that forms a part of the roll-back stop assembly of the coupler shown in FIGS. 9 and 10.
Figure 17:
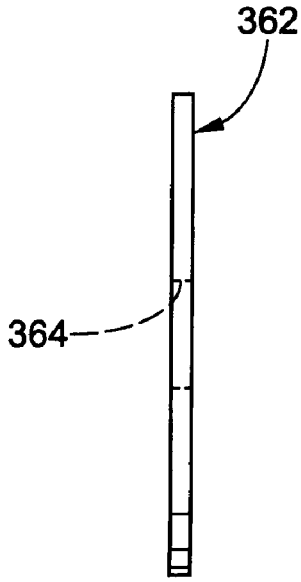

The adjustable stop assemblies 330*a*, 330*b* are identical to each other in terms of their overall structure and function. The second adjustable stop assembly 330*b* is shown in FIGS. 9-11 and comprises a mounting location such as a boss 350 (shown separately in FIGS. 14 and 15) that includes a threaded bore 352 and that is welded or otherwise connected to or formed as a part of the rear face 318 of the frame/body 312 of the coupler 310. A "bumper" or stop member 354 (shown separately in FIGS. 12 and 13) includes or defines a through-bore 356 (including a counter-bore 357) and is bolted or otherwise fixedly secured adjacent the mounting boss 350 by a bolt or other fastener 358 that is threaded into the bore 352 of boss 350 or that is otherwise secured to the coupler frame 312. The fastener 358 is recessed in the counter-bore 357 of bumper 354. The bumper 354 includes or defines an outer surface 360 that is conformed to abut the second arm to which the coupler 310 is pivotally connected at the location P2 when the coupler 310 is pivoted to the full roll-back position. The surface 360 can be rounded and/or sloped as desired. The adjustable stop assembly 330*b* further comprises at least one shim 362 (shown separately in FIGS. 16 and 17) located between the bumper 354 and the mounting boss 350. Each shim 362 includes or defines an aperture 364 to allow for insertion of the bolt or other fastener 358 so that the shim 362 can be assembled in a stack on the boss 350 with the bumper 354. The thickness and/or number of shims 362, both of which vary, is used to control the position of the stop member 354 relative to the boss 350 and, thus, control the angular position for the coupler 310 when the stop member 354 contacts the arm connected to the coupler 310 at location P2.

As noted, the first adjustable stop assembly 330*a* is constructed and functions identically to the second stop assembly 330*b* except that it is positioned so that the outer surface 360 of the bumper 354 thereof contacts the first arm to which the coupler 310 is pivotally connected at pin-on location P1. As shown in FIG. 10, the adjustable stop 330*a* comprises a mounting location such as a boss 350 welded to or defined as a part of the coupler frame 312, and a bumper 354 is fastened thereto by a bolt or other fastener 358, with one or more shims 362 located therebetween.

The "bumper" 354 is preferably defined from a one-piece polyurethane or other polymeric/elastomeric construction having sufficient hardness so as to be durable over extended use while still absorbing some shock and vibration. One example of a suitable material is polyurethane having a durometer hardness of about 60 shore D. The remaining components are defined from metal such as any suitable steel alloys as are generally known in the art. As shown in FIG. 11, a flat washer 370 and a Belleville washer 372 are preferably located between the head of the fastener 358 and the bumper 354. The Belleville washer 372 acts as a lock-washer to inhibit undesired rotation of the fastener 358 due to vibration.

It will be appreciated that the first and second adjustable roll-back stop assemblies 330*a*, 330*b* can alternatively be provided as part of other pin-on attachments including, but not limited to, for example, a bucket, scoop, plow, fork, and the like. Adjustable roll-back stops 330*a*,330*b* are located on opposite first and second lateral sides of the rear face of the attachment (oriented toward the loader or other machine to which the attachment is connected). The first and second roll-back stop assemblies 330*a*, 330*b* are vertically aligned with and spaced from the first and second arm pin-on locations and respectively, so as to be located to contact the respective first and second machine arms to which the attachment is pivotally connected upon full roll-back of the attachment. Alternatively, an attachment may include roll-back stops similar to roll-back stops 200. Additionally, in embodiments, an attachment may further comprise first and second conventional (fixed) dump stops 340*a*, 340*b*, or comprises adjustable dump stops 100 as described above in relation to the coupler 10, adjustable stop assemblies such as stop assemblies 330*a*, 330*b*, or combinations thereof.

Figure 18:
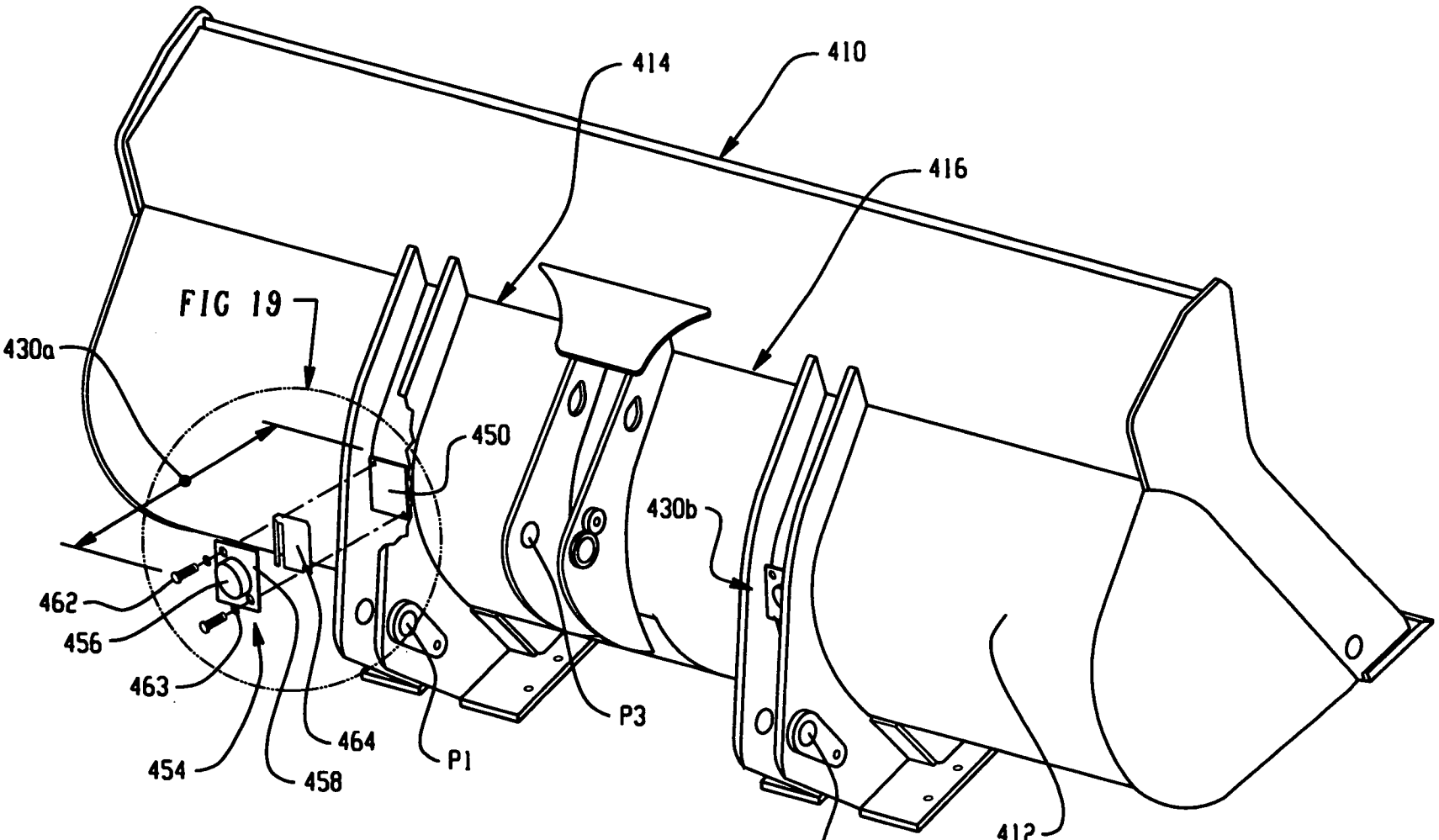
FIG. 18 is a perspective of an attachment, adapted for direct pin-on attachment to a loader or other machine, including adjustable roll-back stops formed in accordance with a second alternative embodiment of the present invention.

FIGS. 18-22 illustrate another embodiment of adjustable stops suitable for use on an attachment such as a loader coupler, bucket, scoop, plow, fork, or the like. With reference to FIG. 18, an attachment (e.g., bucket) 410 is illustrated having attached thereto adjustable rollback stops 430*a* and 430*b*. Attachment 410 comprises first and second arm pin-on locations P1 and P2 where first or second arms of a loader or other machine are respectively pivotally connected to attachment 410. Attachment 410 further comprises at least one tilt-link pin-on location P3 where a hydraulic cylinder or other actuator is operably connected to the attachment 410 in order to control the angular position of the bucket 410 relative to the first and second loader arms.

As seen in FIG. 18, attachment 410 comprises first and second adjustable roll-back stops 430*a*, 430*b* located on opposite first and second lateral sides 414 and 416 of the rear face 412 (oriented toward the loader or other machine to which attachment 410 is connected). First and second roll-back stops 430*a*, 430*b* are vertically aligned with and spaced from the first and second pin-on locations P1, P2, respectively, so as to be located to contact the respective first and second arms, to which the attachment 410 is pivotally connected, upon full roll-back of the bucket.

Figure 19:
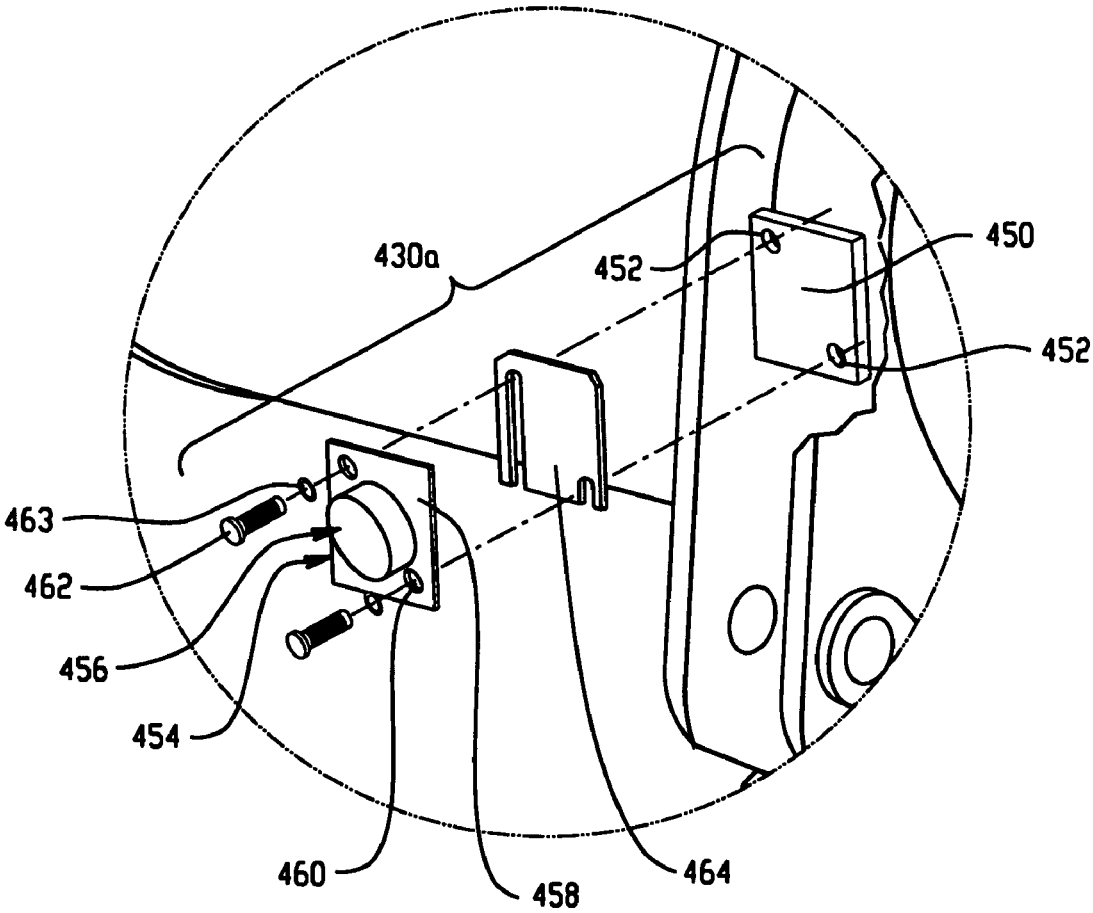
FIG. 19 is an enlarged portion of FIG. 18 showing an exploded view of an adjustable roll-back stop.
Figure 20A:
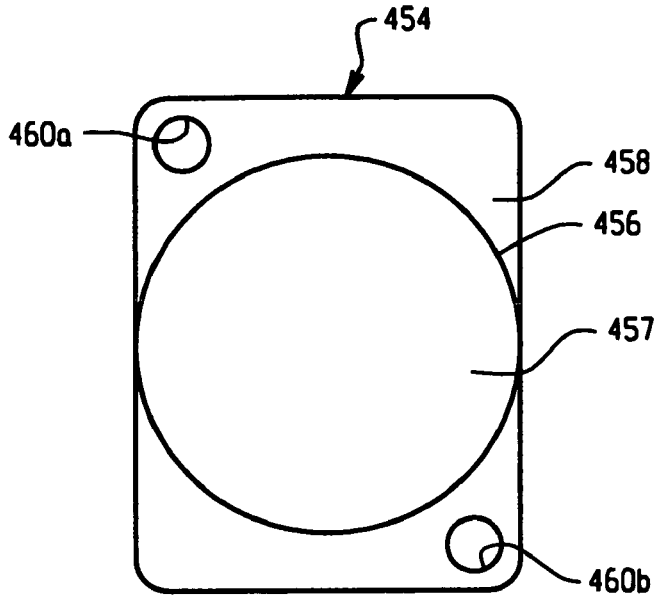
FIGS. 20A and 20B are plan and side elevational views, respectively, of a stop member of the roll-back stop shown in FIGS. 18 and 19.
Figure 20B:
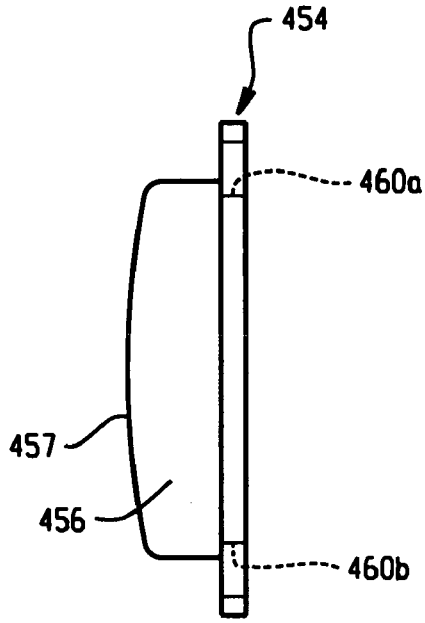
Figure 21A:
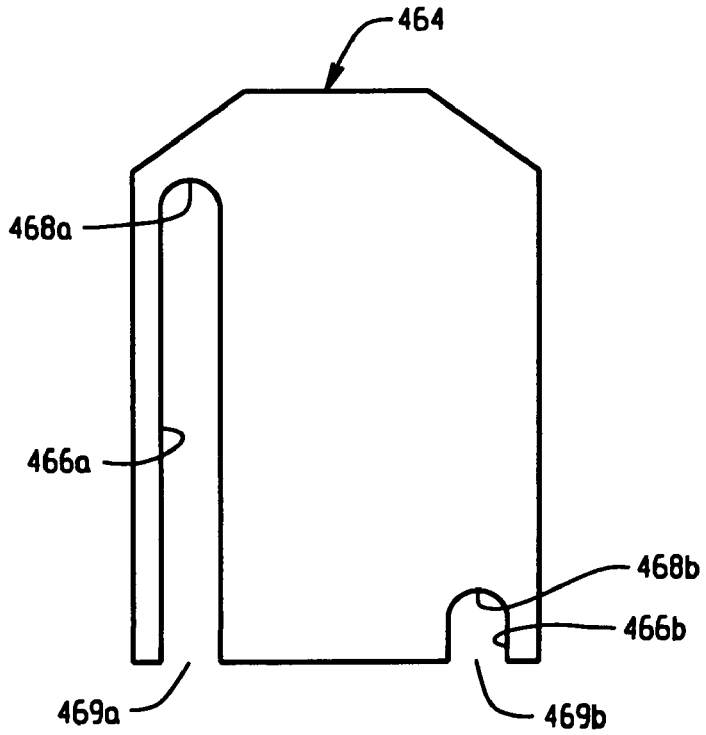
FIGS. 21A and 21B are plan and side elevational views, respectively, of a roll-back stop shim of the adjustable stop assembly shown in FIGS. 18 and 19.
Figure 21B:
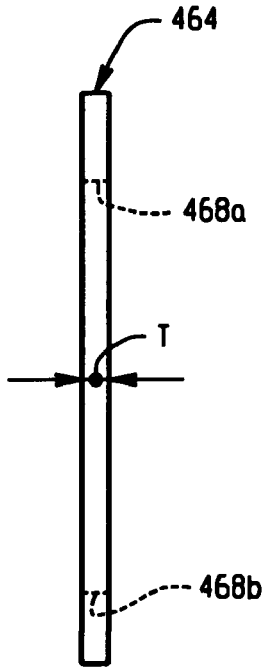
Figure 22A:
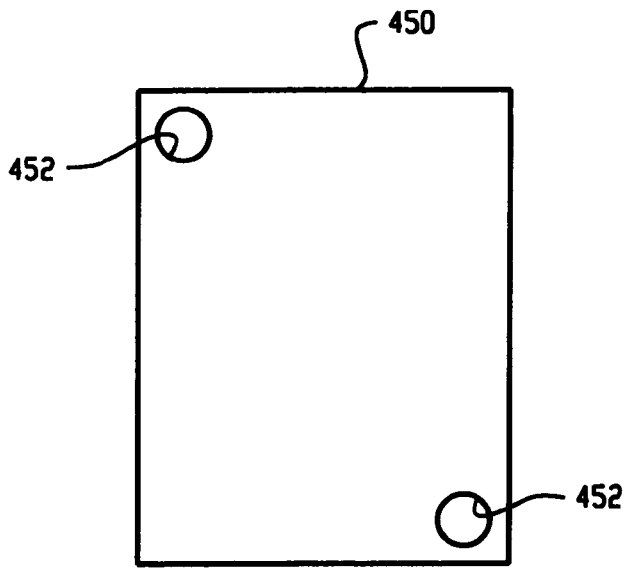
FIGS. 22A and 22B are plan and side elevational views, respectively, of a roll-back stop mounting plate of the adjustable stop assembly shown in FIGS. 18 and 19.
Figure 22B:
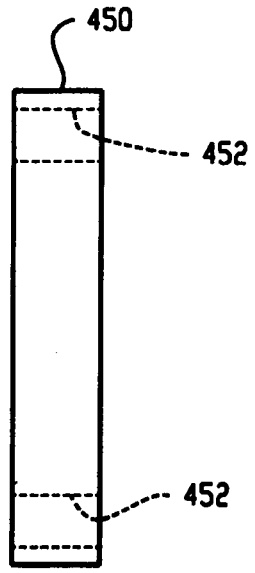

Adjustable stop assemblies 430*a*, 430*b* are identical to each other in terms of overall structure and function. First adjustable stop 430*a* is shown in FIGS. 18 and 19 and comprises a mounting location, such as mounting plate 450 (shown separately in FIGS. 22A and 22B), that includes threaded bores 452. Mounting plate 450 is, in embodiments, connected to or otherwise formed as part of the rear face 412 of attachment 410. Mounting plate 450 may be connected to rear face 412 in any suitable manner including, but not limited to, for example, welding. A stop member 454 (shown separately in FIGS. 20A and 20B) comprises a bumper 456 adjacent a connecting plate 458. Bumper 456 includes and defines a surface 457 that is adapted to abut an arm, such as, in the case of stop assembly 430*a*, the first arm, to which the attachment 410 is pivotally connected. As shown in the embodiment in FIGS. 18-21, bumper 456 has a curved, convex, surface 457. The shape of surface 457 is not limited in any particular manner and may be curved, substantially planar, or angled or sloped as desired. Adjustable stop assembly 430*a* further (optionally) comprises one or more shims 464 (shown separately in FIGS. 21A and 21B) disposed between stop member 454 and mounting plate 450. Shims 464 may be added or removed as desired to change the stop position of roll-back stop 430*a*.

Shim(s) 464 define one or more cut out slots 466*a*, 466*b* to allow for the insertion of a fastener, such as bolt 462, through the shim(s) so that shim(s) can be assembled in a stack on mounting plate 450 and between mounting plate 450 and stop member 454. The position and number of the cut out slots on shims corresponds to the position and number of the bores on the mounting plate and stop member. Cut out slots 466*a*, 466*b* are defined by openings 469*a*, 469*b*, adjacent the bottom portion 467 of the shim, and upper ends 468*a*, 468*b*. The length of the cut out slots 466*a*, 466*b*, i.e., the distance from openings 469*a*, 469*b* to upper ends 468*a*, 468*b*, depends on the location of the bores in the mounting plate and the stop member, as upper ends 468*a*, 468*b* may act as stop positions for the shims and contact a fastener used to connect the components of the stop assembly. For example, in the assembly of adjustable stops 430*a*, 430*b*, a stop member 454 is connected to mounting plate 450 by inserting fasteners 462 through the bores 460 and 452 of stop member 454 and mounting plate 450, respectively. One or more shims 464 may be disposed or positioned between mounting plate 450 and stop member 454 at the time of assembly by lining up the upper ends 468*a*, 468*b* of the respective cut out slots with an upper end of the appropriate corresponding bores and then inserting fasteners 462 therethrough. Alternatively, shims 464 may be added or removed by simply loosening the fasteners and sliding one or more additional shims into or out of position via open ends 469*a*, 469*b* of cut out slots 466*a*, 466*b* as desired. Thus, cut out slots such as, for example, 466*a*, 466*b*, allow for stop assemblies to be adjusted without completely disassembling or removing the cover or stop member, such as, for example, stop member 454, from the mounting plate. In embodiments, such as shown in FIGS. 18 and 19, a washer 463 may be located between the head of fastener 462 and cover plate 458.

As shown in FIGS. 18, 19 and 21, the upper portions 468*a*, 468*b* of cut out slot 466*a*, 466*b* are curved or shaped in a manner corresponding to the shape of a fastener such as, for example, a screw. It will be appreciated that the shape of the upper portion of the cut out slot is not critical or limited in any manner and may be curved, substantially straight or planar, angled or otherwise shaped as desired.

The shape and size of shims 464 is not critical or limited in any manner. In embodiments, shims 464 have a shape similar to the shape of the mounting plate and/or the cover. As seen in FIGS. 18, 19 and 21, shims 464 have an angled portion near the upper portion of the shims. The shims may have a length that is less than, equal to, or greater than the length of the mounting plate and/or cover. The thickness T of shims 464 is not limited and may be selected as desired to be useful in a particular application. Additionally, the number of shims employed in an adjustable stop assembly, such as roll-back stops 430*a*, 430*b*, may be varied as desired to suit a particular purpose or application. The number and/or thickness of the shims 464 is varied to control the position of the stop member, and in particular the surface such as, for example, bumper 456 of stop member 454, relative to the mounting plate and, thus, control the angular position of the attachment, such as, for example, bucket 410, when bumper 456 contacts an associated arm connected to the attachment. In embodiments, an adjustable stop assembly may include zero (0) or no shims disposed between the mounting plate and the cover. Alternatively, an adjustable stop assembly may be adjusted by adding one or more shims between the mounting location and the stop member. It will be appreciated that it may be necessary to change the length of the fastener used to assemble the stop assembly as shims are added or removed to ensure that the components (i.e., the mounting plate, shims, and cover) are in a snug engaging contact (if desired).

As noted, second adjustable stop assembly 430*b* is constructed and functions identically to the second stop assembly 430*a* except that it is positioned so that the outer surface 457 of bumper 456 contacts the second arm to which bucket 410 is pivotally connected at pin-on location P2. In embodiments, the number and thicknesses of the shims employed in a first stop assembly may differ from the number and/or thickness of the shims employed in a second stop assembly, which is connected to the same attachment as the first stop assembly, to provide different stop locations which may be required to accommodate and account for any variances in the machine that may cause such different positions.

Bumper 456 is, in embodiments, defined from a one-piece polyurethane or other polymer/elastomeric constructions having sufficient hardness so as to be durable over extended use while still absorbing some shock and vibration. A non-limiting example of a suitable material is a polyurethane having a durometer hardness of about 60 shore D. The shims may be constructed from any suitable material including metal materials or polymer/elastomeric constructions. In embodiments, the shims are formed from a rigid polymeric material. In embodiments, the remaining components, such as the mounting plate 450 and cover plate 458 may be formed from a metal including, but not limited to, steel, steel alloys, and the like.

While the stop assemblies in FIGS. 18-22 were shown and described with reference to an attachment bucket, it will be appreciated that such assemblies are also suitable for use on other attachments including, but not limited to, loader couplers, scoops, plows, forks, and the like. While the stop assemblies in FIGS. 18-22 were described with reference to roll-back stops, it will be appreciated that stop assemblies such as, for example, stop assemblies 430*a*, 430*b* may also be used as dump stops. It will also be appreciated that an attachment may further comprise first and second dump stops, including conventional fixed dump stops, or adjustable dump stops including dump stops having a configuration similar to the adjustable stop assemblies 430*a*, 430*b* or stop assemblies such as, for example, stop assemblies 100 or 200. It will be further appreciated that adjustable stop assemblies 430*a*, 430*b* may also be employed as either roll-back stops and/or dump stops on a loader coupler.

The invention has been described with reference to preferred embodiments. Of course, modifications and alterations will occur to others upon a reading and understanding of the preceding specification. It is intended that the invention be construed as including all such modifications and alterations.

The invention claimed is:

1. A loader coupler for selective releasable coupling of an attachment to an associated loader machine, said loader coupler comprising:

first and second arm pin-on locations adapted for pivotable connection to respective first and second arms of the associated loader machine;

at least one tilt-link pin-on location adapted for pivotable connection to an actuator of the associated loader machine that controls an angular position of the coupler;

first and second attachment pick-up locations adapted to be selectively engaged with respective first and second ribs of the associated attachment to be coupled to the associated loader machine;

a lock assembly for selectively capturing the first and second ribs of the associated attachment to the coupler;

first and second adjustable roll-back stop assemblies located on opposite lateral sides of the coupler, each of said roll-back stop assemblies comprising:

a metallic mounting location;

a polymeric bumper releasably connected to said metallic mounting location; and at least one shim located between said mounting location and said polymeric bumper, said at least one shim releasably captured between said mounting location and said polymeric bumper so as to be selectively removable from said loader coupler.

2. The loader coupler of claim 1, wherein said polymeric bumper defines a through-bore and counterbore, said polymeric bumper being releasably secured to said mounting location by a fastener that extends through said through-bore and counterbore, and through said at least one shim, wherein a head of said fastener is located in said counterbore and recessed relative to an outer surface of said polymeric bumper.

3. The loader coupler of claim 1, wherein at least one of said roll-back stop assemblies comprises multiple shims located between said polymeric bumper and said mounting location.

4. The loader coupler of claim 3, wherein at least one of said multiple shims exhibits a thickness that varies relative to a thickness of at least one of another of said multiple shims.

5. The loader coupler of claim 1, wherein said polymeric bumper comprises polyurethane.

6. The loader coupler of claim 1, wherein said polymeric bumper comprises polyurethane having a durometer hardness of about 60 shore D.

7. The loader coupler of claim 6, wherein said polymeric bumper defines a through-bore and a counterbore and wherein said polymeric bumper is releasably connected to said mounting location by a fastener that extends through said through-bore and counterbore, and through said at least one shim, wherein a head of said fastener is located in said counterbore and recessed relative to an outer face of said polymeric bumper.

8. The loader coupler of claim 7, wherein said polymeric bumper defines a rounded outer surface.

9. The loader coupler of claim 7, wherein said polymeric bumper defines a sloped outer surface.

* * * * *